US006335520B1

(12) United States Patent
Lee et al.

(10) Patent No.: US 6,335,520 B1
(45) Date of Patent: Jan. 1, 2002

(54) MICROWAVE OVEN AND A METHOD FOR CONTROLLING THE SAME

(75) Inventors: Jong-hak Lee, Koyang; Young-won Cho; Sung-ho Lee, both of Suwon; Tae-soo Kim, Seoul, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/756,884

(22) Filed: Jan. 10, 2001

(30) Foreign Application Priority Data

Jul. 27, 2000 (KR) ..... 00-43478

(51) Int. Cl.[7] ..... H05B 6/68

(52) U.S. Cl. ..... 219/716; 219/721; 363/21; 363/49

(58) Field of Search ..... 219/716, 715, 219/702, 721; 363/21, 97, 98, 49

(56) References Cited

U.S. PATENT DOCUMENTS 4,012,617 A * 3/1977 Burke et al. ..... 219/716
4,873,408 A * 10/1989 Smith et al. ..... 219/716
5,171,949 A * 12/1992 Fujishima et al. ..... 219/721

FOREIGN PATENT DOCUMENTS

JP 1-221884 * 9/1989 ..... 219/716
JP 1-292790 * 11/1989 ..... 219/716
JP 1-313887 * 12/1989 ..... 219/716
JP 4-198627 * 7/1992 ..... 219/716

* cited by examiner

*Primary Examiner*—Philip H. Leung
(74) *Attorney, Agent, or Firm*—Robert E. Bushnell, Esq.

(57) ABSTRACT

Disclosed is a microwave oven comprising a power supply part supplying a commercial alternating current (AC) power, a rectifying and filtering part rectifying and filtering the commercial AC power, a high voltage transformer generating a high voltage by means of direct current (DC) power from the rectifying and filtering part; and a magnetron generating electromagnetic waves based on the high voltage from the high voltage transformer, further comprising a control signal generator part generating a control signal; an inverter part converting the DC power from the rectifying and filtering part into a high voltage AC power based on the control signal from the control signal generator part, and a control part blocking the control signal converted through the inverter part from being applied to the magnetron if the converted control signal is not within a predetermined range. With this configuration, the converted control signal which is not within the predetermined range allowed by the control signal can be prevented from entering into the circuit in advance, thereby stabilizing the circuit and improving the stability of the circuit system more and more.

21 Claims, 6 Drawing Sheets

MICROWAVE OVEN AND A METHOD FOR CONTROLLING THE SAME

CLAIM OF PRIORITY

This application makes reference to, incorporates the same herein, and claims all benefits according under 35 U.S.C. §119 from an application for MICROWAVE OVEN AND CONTROL METHOD THEREOF earlier filed in the Korean Industrial Property Office on the Jul. 27, 2000 and there duly assigned Serial No. 43478/2000.

BACKGROUND OF THE INVENTION

1. Field of the Invention

The present invention relates in general to a microwave oven and a method for controlling the same, and more particularly, to a microwave oven and a method for controlling the same, capable of stabilizing a circuit system therein by controlling a conversion control signal.

2. Description of the Related Art

FIG. 6 is a circuit diagram schematically showing a figuration of a conventional microwave oven. As shown therein, the conventional microwave oven is comprised of a power supply part 51, a high voltage transformer 53 generating a high voltage by means of the power supplied from the power supply part 51, a magnetron 55 generating electromagnetic waves by means of the high voltage generated by the high voltage transformer 53 to heat food within a cooking compartment of the microwave oven, a relay switch 57 switching on and off the supply of the power and a frequency, and a control part 59 controlling the high voltage transformer 53, the magnetron 55 and the relay switch 57 when the power is supplied from the power supply part 51.

With this configuration, if the power is supplied from the power supply part 51 and the relay switch 57 turns on by means of control of the control part 59, an electric current starts to flow at the primary winding of the high voltage transfer, thereby generating a high voltage at the secondary winding of the high voltage transformer 53. In the secondary winding of the high voltage transformer 53 are provided a voltage having a few volts to heat filaments of the magnetron 55 and a voltage of thousands volts to oscillate the magnetron 55. In order to apply a direct current to a negative pole of the magnetron 55, a rectifying and filtering means for rectifying and filtering the electric current is also provided therein.

However, since the core of the high voltage transformer 53 used in the conventional microwave oven is made of a silicon steel sheet, it is heavy and bulky, and it is inconvenient for consumers to handle it. Because the number of turns for the secondary winding of the high voltage transformer should increase in order to generate a high voltage from the high voltage transformer 53, this causes a problem that the high voltage transformer 53 must further increases in dimension.

In addition, to adjust an output voltage from the secondary winding of the high voltage transformer, the conventional microwave oven employs a method of controlling a duty cycle, because it is not possible to perform an analog control from a low output to a high output. The duty cycle control method controls the maximum rated output supplied from the power supply part 51 with a ratio of an on time and an off time of the high voltage transformer. In the duty cycle control method, if the on-time of the maximum rated output is short and the off-time thereof is long, the low output is generated, whereas the high output is generated if the on-time of the maximum rated output is long and the off-time thereof is short. Where the output is adjusted by the duty cycle control method, there is a great variation in temperature affecting cooking of food, which may lower an efficiency in cooking and further cause the food to be ill-tasting.

SUMMARY OF THE INVENTION

Accordingly, the present invention has been made in view of the above-described shortcomings, and it is an object of the present invention to provide a microwave oven able to facilitate an output control by allowing a high voltage transformer to continuously and variably generate a high voltage output from the secondary winding thereof in an analog form.

This and other objects of the present invention may be achieved by a provision of a microwave oven, comprising a microwave oven comprising a power supply part supplying a commercial alternating current (AC) power, a rectifying and filtering part rectifying and filtering the commercial AC power, a high voltage transformer generating a high voltage by means of direct s current (DC) power from the rectifying and filtering part; and a magnetron generating electromagnetic waves based on the high voltage from the high voltage transformer, further comprising a control signal generator part generating a control signal; an inverter part converting the DC power from the rectifying and filtering part into a high voltage AC power based on the control signal from the control signal generator part, and a control part blocking the control signal converted through the inverter part from being applied to the magnetron if the converted control signal is not within a predetermined range.

The control part includes a D/A converter part converting the control signal from the control signal generator part into an analog signal, a detector part detecting whether the control signal converted by the D/A converter part is within the predetermined range, an output control part controlling an output of the control signal passing through the detector part, and an oscillator part varying the control signal outputted by the output control part and inputting the varied control signal into the inverter part.

The control part further includes an on-off and soft starter part controlling an on-off operation and a soft start operation of the oscillator part depending upon the control signal.

The control part further includes a low voltage off part supplying a stop signal to the on-off and soft starter part and the D/A converter part where an abnormal power is inputted through the power supply part, to stop an operation of the on-off and soft starter part and the D/A converter part.

The control signal detected by the detector part is applied to an input terminal of the output control part.

The output control part uses a resistance property between a drain and a source of a field effect transistor (FET).

The oscillator part includes a switching part switching the DC power into an AC power.

An oscillating frequency of the oscillator part is given an expression $Fo=1/(1.4\times(\text{external resistance}+75)\times\text{capacitor})$.

The on-off and soft starter part uses a resistance property between a drain and a source of an FET.

The low voltage off part includes a transistor and a photo coupler which are connected in series to each other, to form a logical product (AND) circuit element.

The high voltage transformer includes a ferrite core to minimize a loss in a high frequency. frequency.

A method controlling a microwave oven including a power supply part supplying a commercial alternating current (AC) power, a rectifying and filtering part rectifying and filtering the commercial AC power, an inverter part converting a DC power from said rectifying and filtering part into an AC power of a high frequency, a high voltage transformer generating a high voltage by means of the AC power from the inverter part, and a magnetron generating electromagnetic waves based on the high voltage from the high voltage transformer, includes the steps of generating a control signal, applying the control signal to the inverter part so that the inverter part converts the DC power from the rectifying and filtering part into the high frequency AC power, detecting whether the control signal converted through the inverter part is within a predetermined range, and preventing the control signal from being applied to the magnetron if the control signal is not within the predetermined range.

The method further includes the steps of determining whether the control signal to be applied to the inverter part is within the predetermined range and preventing the control signal from entering into the inverter part if the control signal is not within the predetermined range.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
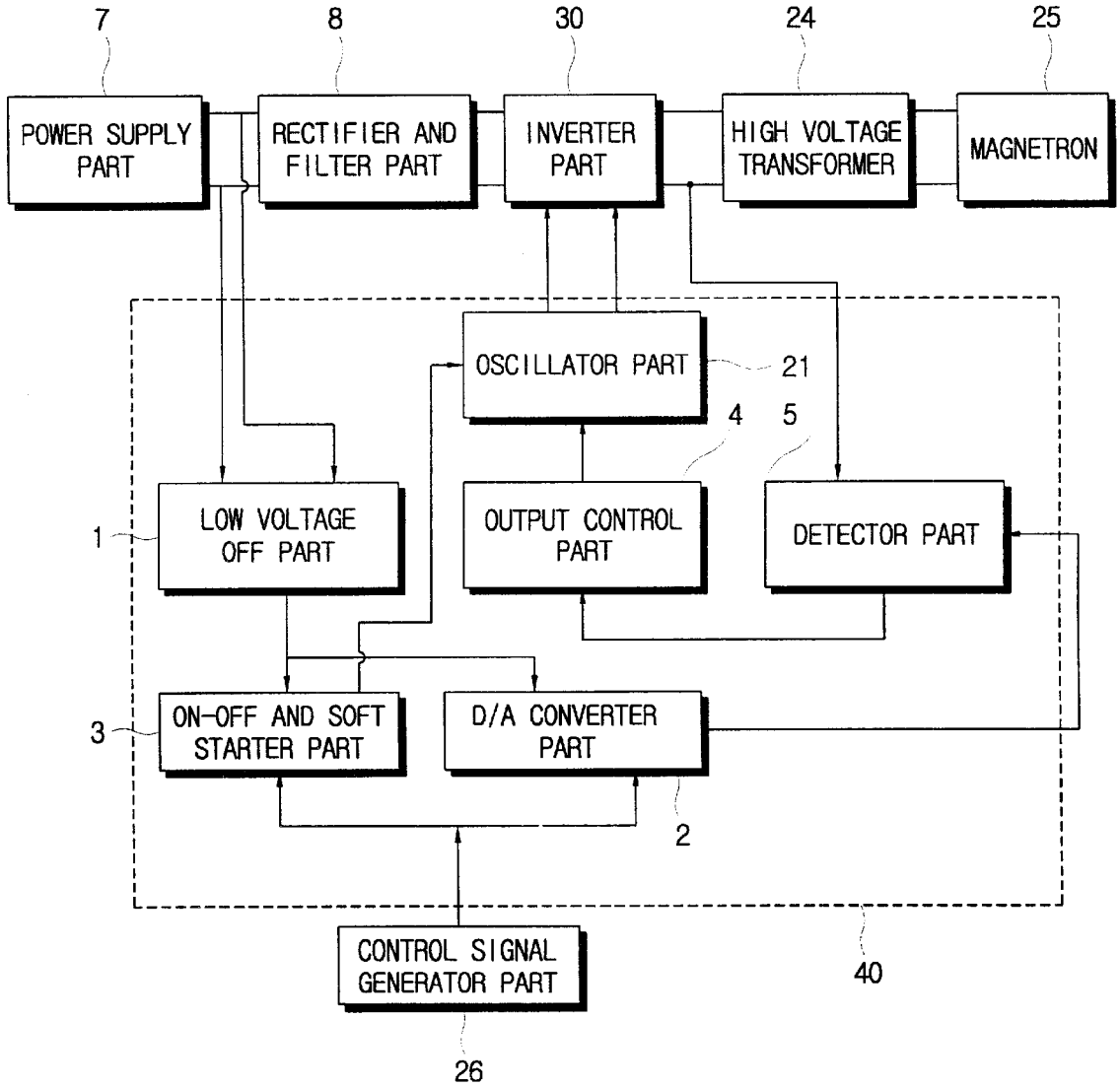
FIG. 1 is a block diagram of a microwave oven according to the present invention.
Figure 2:
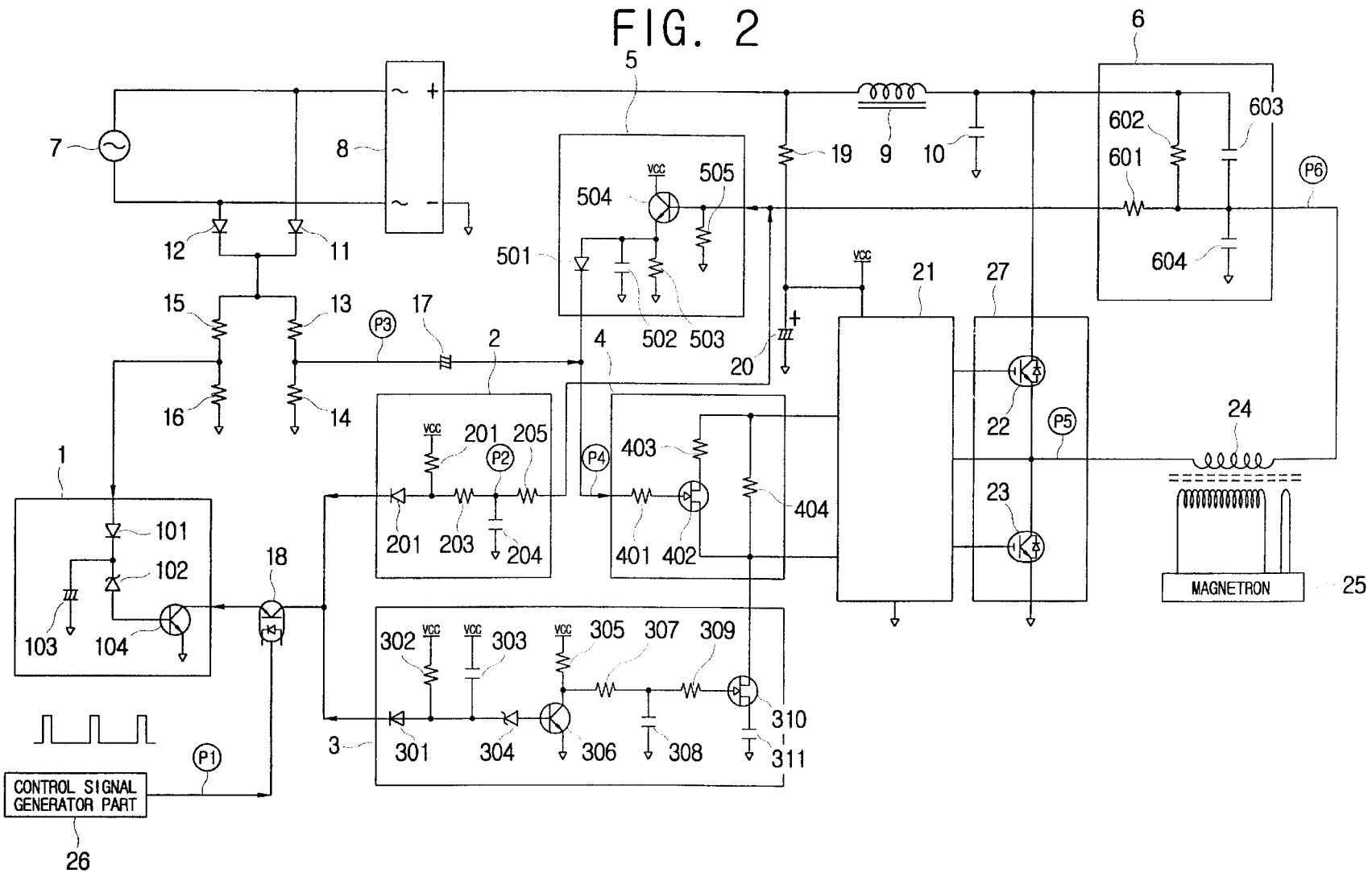
FIG. 2 is a detailed circuit diagram for FIG. 1.

Referring to FIGS. 1 and 2, a microwave oven according to the present invention includes a power supply part 7 supplying a commercial alternating current(AC) power, a rectifying and filtering part 8 rectifying and filtering the electric power supplied from the power supply part 7, a high voltage transformer 24 generating a high voltage based on the commercial AC power, and a magnetron 25 generating electromagnetic waves by means of the high voltage generated by the high voltage transformer 24.

A reactor 9 (see FIG. 2) and a filtering capacitor 10 (also see FIG. 2) are connected to the rectifying and filtering part 8, to thereby prevent a noise from the inverter part from being discharged outside. A resistor 19 and a filtering capacitor 20 connected to the rectifying and filtering part 8 reduces the high voltage approximately 310V rectified in the rectifying and filtering part 8 to a voltage having about 15V in order to use it as a semiconductor driving power.

The microwave oven according to the present invention includes a control signal generator part 26 generating a control signal, and an inverter part 30 connected to a primary winding of the high voltage transformer 24, the inverter part 30 converting a DC power rectified and filtered through the rectifying and filtering part 8 into a high voltage AC power based on the control signal inputted through the control signal generator part 26. In the inverter part 30 is provided a resonator part 6 connected in series to the primary winding of the high voltage transformer 24, performing an operation of resonance.

In addition, the microwave oven according to the present invention includes a control part 40 controlling the control signal converted through the resonator part 6 of the inverter part 30, if the converted control signal is not within a predetermined range of the control signal, so that the converted control signal is within the predetermined range.

The control part 40 receives the control signal from the control signal generator part 26 and determines whether the control signal is within the predetermined range. Where the control signal is determined not to be within the predetermined range, the control part 40 prevents the control signal from being applied to the inverter part 30.

The control part 40 is provided with a D/A converter part 2 converting the control signal from the control signal generator part 26 into an analog signal, a detector part 5 detecting the control signal converted by the D/A converter part to determine whether the control signal is within a predetermined range, an output control part 4 controlling and outputting the control signal detected by the detector part 5, and an oscillator part 21 varying the control cycle of the control signal outputted by the output control part 4 and applying it to the inverter part 30. The oscillator part 21 is comprised of a switching part 27 converting the DC power into an AC power; and the switching part 27 is provided with a pair of switching power elements.

The control part 40 includes an on-off and soft starter part 3 controlling an on-off and soft start operation of the oscillator part 21 according to the control signal inputted by the control signal generator part 26, and a low voltage off part 21 outputting a stop signal to the on-off and soft starter part 3 and the D/A converter part 2 where the commercial DC power inputted through the power supply part is determined to be abnormal. The control part 40 divides the control signal generated by the control signal generator part 26 and inputs the divided control signals into the D/A converter part 2 and the on-off and soft starter part 3, respectively.

The flow of the control signal divided into the D/A converter part 2 will be described in more detail.

The control signal divided into the D/A converter 2 are converted into an analog signal and the converted analog signal is applied to the detector part 5. Where the control signal applied to the detector part 5 is determined to be within the predetermined range by the control part 40, the control part 40 applies the control signal to an input terminal of the output control part 4. The control signal applied to the output control part 4 is applied to the input terminal of the oscillator part 21, varied by the oscillator part 21 and then inputted into the inverter part 30. The control signal inputted into the inverter part 30 is converted into the AC power having a high frequency and supplied into the magnetron 25 through the primary and secondary windings of the high voltage transformer 24, thereby generating electromagnetic waves.

The control part 40 determines whether the converted control signal through the inverter part 30 is within the predetermined range. Where the control part 40 determines that the converted control signal is not within the determined range, the control part 40 blocks the converted control signal from being applied to the magnetron 25. If the converted signal control signal is determined to be within the predetermined range, the control part 40 applies the converted control signal to the magnetron 25 via the output control part 4 and the inverter part 30.

Further, as described above, where the control part 40 determines that the control signal passing through the D/A converter part is not within the predetermined range, the control part 40 blocks the control signal from being applied to the output control part 4, thereby protecting the circuit in a more stable manner.

Because the high voltage transformer 24 is driven with a high frequency (about 20 Kilo-Hertz) through the semiconductor oscillation, it is effective to use a ferrite core minimizing the loss of the high frequency, thereby having no need to increase the number of turns of the secondary winding of the high voltage transformer 24. The high voltage transformer employing the ferrite core is less in dimension and weight compared with the conventional core type high voltage transformer.

The D/A converter part 2, the on-off and soft starter part 3, the oscillator part 21, the output control part 4, etc. constituting the control part 30 will be described in more detail, referring to FIG. 2.

When the power is initially supplied to the microwave oven from the power supply part 7 or when the microwave oven is on standby, the control signal is not inputted to the input terminal of a photo coupler 18 connected to the control signal generator part 26 from the signal generator part 26, and therefore, the inverter part 30 is in no operation. This means that the oscillation from the inverter part 30 does not occur. To allow the inverter part 30 to oscillate, pulse width modulation (PWM) waveforms should be continuously applied through an input terminal (P1) of the photo coupler 18 from the control signal generator part 26.

The PWM waves applied to the photo coupler 18 functions to operate (start oscillation) of the inverter part 30 and to control an output of the inverter part 30 by varying oscillation frequencies of the oscillator part 21 depending upon changes in pulse width of the PWM waveforms.

When the PWM waveforms are not applied to the on-off and soft starter part 3, a transistor 306 constituting the on-off and soft starter part 3 turns on with a base thereof biased by a resistor 302 and a capacitor 303. If the transistor 306 turns on, a gate potential of a field effect transistor (FET) 310 becomes minimum and the resistance between a drain and a source of the FET 310 becomes infinitely great. When the resistance between the drain and the source of the FET becomes infinitely great, a capacitor 311 results in being separated from the oscillator part 21, thereby allowing the oscillation of the oscillator part 21 to stop. Thus, the inverter part 30 stops operating Conversely, where the PWM waveforms are applied to the on-off and soft starter part 3, the base bias of the transistor 306 is drained out through an orientation diode 301, thereby allowing the transistor 306 to turn off. A zener diode 304 interrupts the residue base bias of the transistor 306, allowing the transistor to maintain the state. If the transistor 306 turns off, a filter capacitor 308 is slowly charged with a VCC voltage through the resistor 305 and the gate resistor 307. Accordingly, the resistance between the drain and the source of the FET 310 slowly becomes decreased, and the oscillating capacitor 311 result in being combined with the oscillator part 21, thereby initiating the oscillation.

Where the PWM waveforms are applied to the input terminal of the photo coupler 18, the values of the analog voltage of the D/A converter 2 are determined depending upon the relation between high values and low values in the PWM waveforms.

Where the voltage value (P2) is lowered, the value of resistance between the drain and the source of the FET 402 is increased to allow the oscillating frequencies to be lowered and the output of the inverter part 30 to be increased. A resistor 201 is for a gate bias voltage of the FET 402; and the resistors 203 and 205 and a capacitor 204 are π types filters, converting digital PWM waveforms into analog waveforms, which are applied to the FET 310 through a gate resistor 401.

As described above, the element coupling and separating the oscillator part 21 and the oscillating capacitor 311 is the resistor between the drain and the source of the FET 310. Where the resistor between the drain and the source is high, the capacitor 311 results in having a lower capacity, thereby increasing the oscillating frequencies. Conversely, where the resistor between the drain and the source is so low as to be ignored, the oscillation occurs for the whole capacity of the capacitor 311.

Where the oscillating frequency is high, the output of the inverter part 30 becomes decreased. Thus, when the inverter part 30 starts to oscillate, it is desirable to increase the oscillating frequency as high as possible to allow the output to be the minimum, and then to slowly lower the frequency until the desired output is obtained, thereby giving no burden to the various electric elements. The soft start operation considers all the properties of the oscillating frequency and the inverter part 30. The present invention realizes the soft start by means of the resistance property between the drain and the source of the FET 310.

Hereinbelow, the output control part of the present invention will be described in more detail.

The oscillator part 21 oscillates by itself, when and external resistor (RT) and a capacitor (CT) are connected structurally, generating gate pulses of the switching elements 22 and 23.

The oscillating frequency Fo of the oscillator part 21 is obtained by the equation of Fo=1/4(1.4*(RT+75)*CT), wherein the external resistance(RT)=resistance(404)/{resistance(403)+the resistance (402) between the drain and the source and the capacitor (CT)=capacitor(311).

The oscillating frequency can vary by changing the value of external resistance (RT). The inverter part according to the present invention uses the resistance properties between the drain and the source of the FET 402 to change the external resistance value.

The variation of the oscillating frequency aims at improving a power factor of the inverter part 30, in addition to controlling the output of the inverter part 30. Where an output is made from the inverter part 30 considering no improvement of the power factor, the voltage of the secondary winding of the high-voltage transformer 24 is determined in proportion to the voltage supplied through the power supply part. The supplied voltage has a waveform resulting from rectification of the commercial AC power, the secondary high voltage has also the same waveform as the rectified waveform. Consequently, the magnetron 25 is operated in proximity to top points (90° and 270° of the commercial AC signal) of the secondary high voltage. In reverse, the operation of the magnetron 25 stops in proximity to zero crossing points (0° and 180° of the commercial AC signal) because the secondary high voltages is low, which shortens the durability of the oscillating element of the magnetron and deteriorates the efficiency of electric energy. Therefore, it is preferable to provide the oscillating element of the magnetron with a load property similar to that of the possible resistance over the whole range of the commercial AC power waveforms. through the power supply part. The supplied voltage has a waveform resulting from rectification of the commercial AC power, the secondary high voltage has also the same waveform as the rectified waveform. Consequently, the magnetron 25 is operated in proximity to top points (90E and 270E of the commercial AC signal) of the secondary high voltage. In reverse, the operation of the magnetron 25 stops in proximity to zero crossing points (0E and 180E of the commercial AC signal) because the secondary high voltages is low, which shortens the durability of the oscillating element of the magnetron and deteriorates the efficiency of electric energy. Therefore, it is preferable to provide the oscillating element of the magnetron with a load property similar to that of the possible resistance over the whole range of the commercial AC power waveforms.

Figure 3:
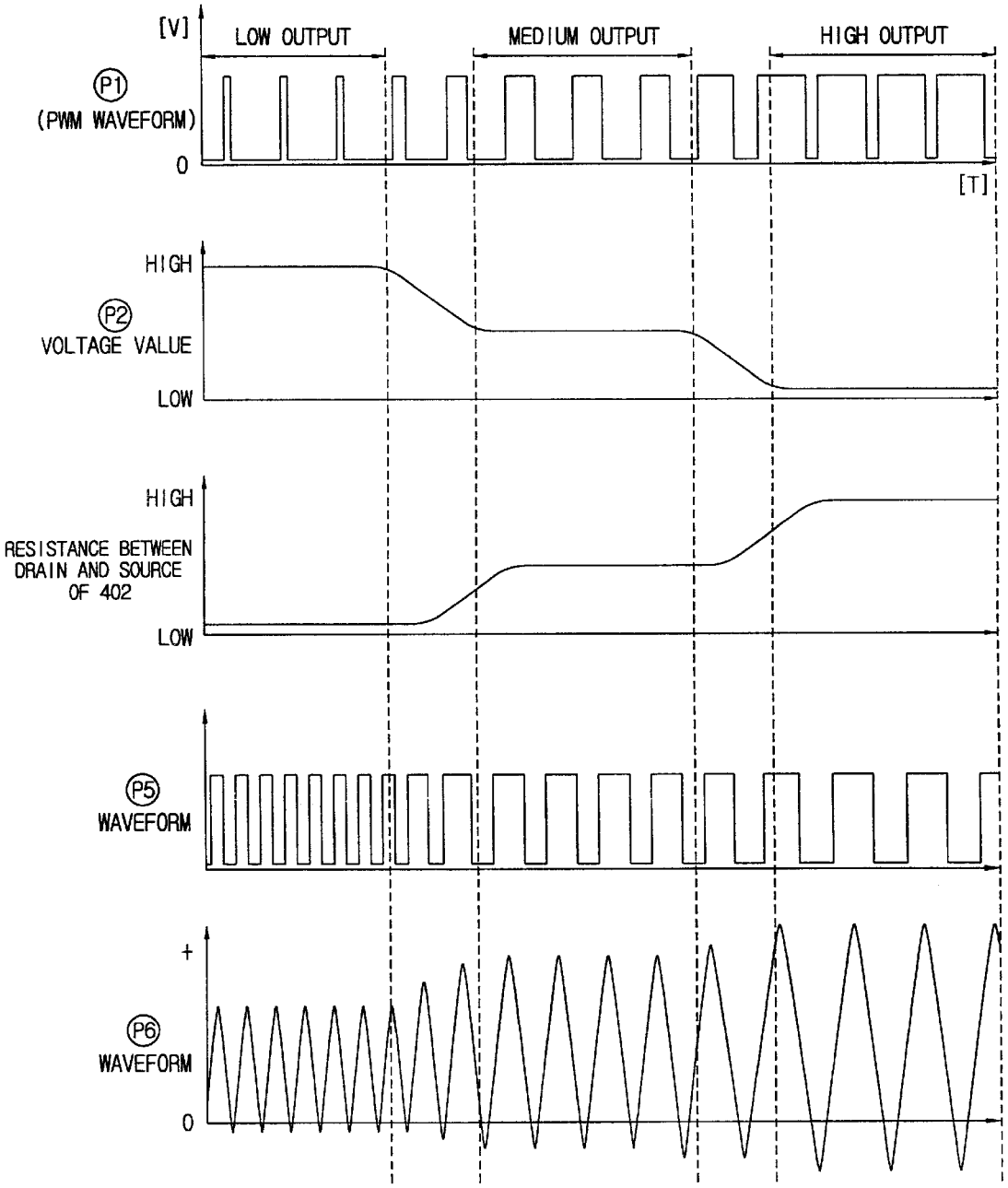
FIG. 3 shows graphs for electric potentials and waveforms of several points in FIG. 2.

As shown in FIG. 3 which shows graphs for an electric potentials and waveforms of several points of FIG. 2, the improvement of the power factor is to allow the magnetron 25 to have a uniform load over the whole section of the AC signal. However, it is not easy for the magnetron 25 to have a uniform load over the whole section of the DC signal under the non-linear load structure, which is merely possible in pure resistance load. Thus, to operate the magnetron 26 to have the uniform load properties, the operational voltage should be calibrated reversely.

The reverse calibration of the operational voltage is accomplished by lowering the high voltage supplied to the magnetron, in proximity to 90° and 270°, at which the magnetron is the most actively operated, and enhancing the high voltage in proximity to 0° and 180°, at which the magnetron is the least actively operated. Hence, electric current approximate to the pure resistance load may be obtained.

Figure 4:
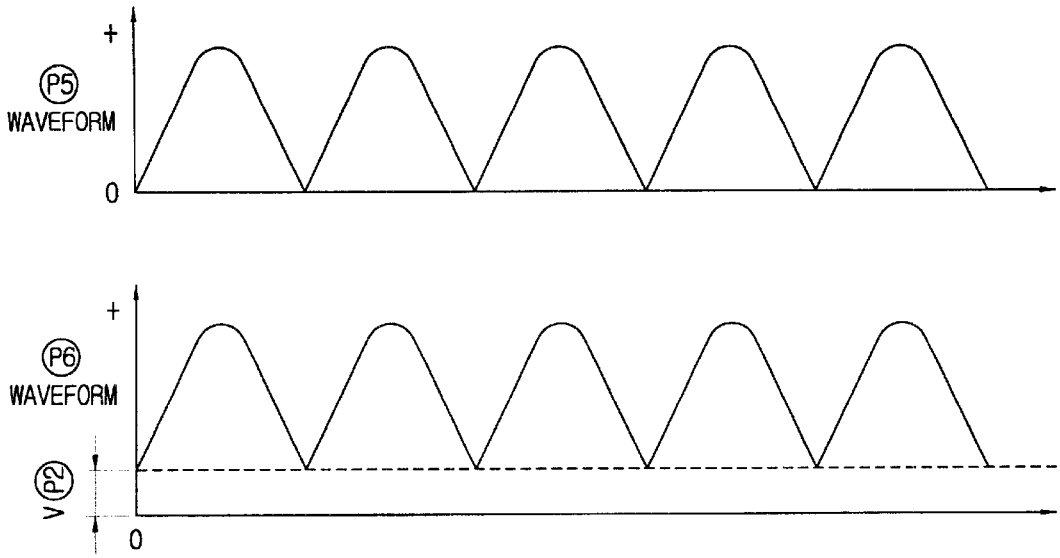
FIG. 4 shows graphs for waveforms obtained by overlapping direct currents (DC) with source signal for improving a power factor.

Diodes 11 and 12 are full wave rectifier circuit elements to obtain an AC signal waveform necessary for improving the power factor and operating the low voltage off part 1. The obtained waveform signal is converted into low voltage by attenuator resistance elements 13 and 14 and transmitted into the gate of the output control part 4 through the capacitor 17. The capacitor 17 can transmit only the AC signal without lowering gate bias voltage of the output control part 4, thereby allowing the FET 402 to be always in the operable range.

Where the phase angles are 90° and 270°, the strength of the gate bias voltage(P4) is obtained by weighing a sign wave over the reference bias voltage(P2), so that the resistance value between the drain and the source of the FET 402 is changed, allowing the output of the inverter part 30 to vary. That is, where the phase angles are 90° and 270°, the resistance value between the drain and the source of FET 402 becomes the least and the oscillating frequency of the oscillator unit 21 becomes the maximum accordingly, thereby lowering the output of the inverter part. FIG. 4 shows graphs for waveforms of source signals for improving the power factor with DC being overlapped. As described above, the reference source for improving the power factor is obtained from the commercial AC power; and to improve the power factor, the variation in resistance between the drain and the source of the FET is used.

The low voltage off part 1 is used so as to protect the various power elements by suspending the operation of the inverter part 30, where the AC input voltage is extremely low because of abnormal power lines or falling of a thunderbolt. The filter capacitor 103 is charged with the AC signal converted into low voltages by the attenuation resistors 15 and 16 through the diode 101 of the low voltage off part 1. When the AC signal charging the filter capacitor 103 are lower than the predetermined value of the zener diode 102, the transistor 104 is off, to erase the PWM waveforms applied to the photo coupler 18 and suspend the oscillation of the inverter part 30. The photo coupler 18 and the transistor 104 of the low voltage off part 1 are connected in series to each other, and thus these elements are in the form of logic product, that is, AND, so that the resultant turns off if either of them turns off.

Where a resonance voltage generated in the resonance part 6 is higher than a predetermined value, the detector part 5 applies the resonance voltage to the base of the transistor 504 through divided voltage resistors 601 and 505. After an emitter resistor 503 and a charging capacitor 502 are charged with the resonance voltage applied to the transistor 504, the resonance voltage is applied to the input terminal of the output control part 4 through the diode 501.

The resonance voltage of the resonance part 6 is abnormally risen because it is affected by surge noises entering over the power line. To protect the circuits from the surge noises, according to the present invention, the abnormal resonance voltage is converted into normal voltage by means of a transistor employing an emitter-floor mechanism, and the converted normal voltage is fed back to the input terminal of the output control part 4, thereby allowing the resonance part to operate in a closed-loop.

Figure 5:
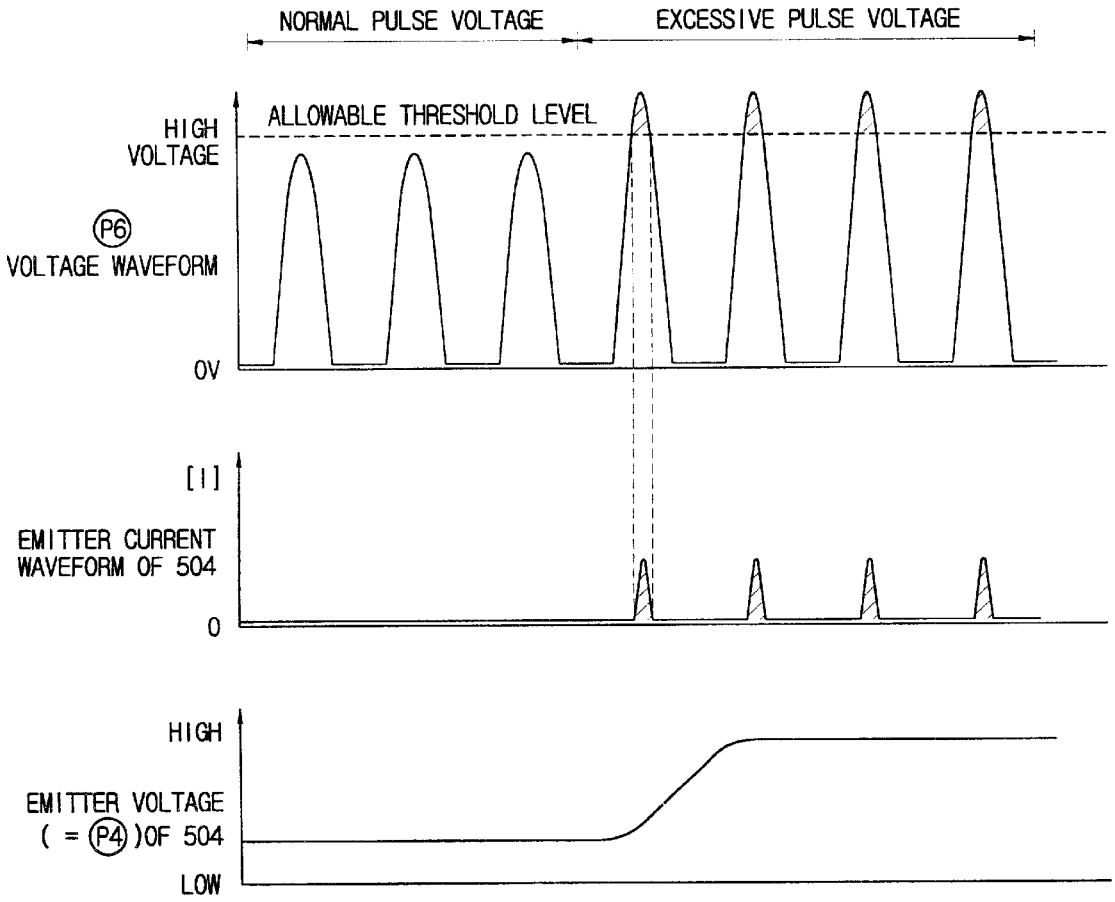
FIG. 5 is a graph showing operational characteristics of a detector part.
Figure 6:
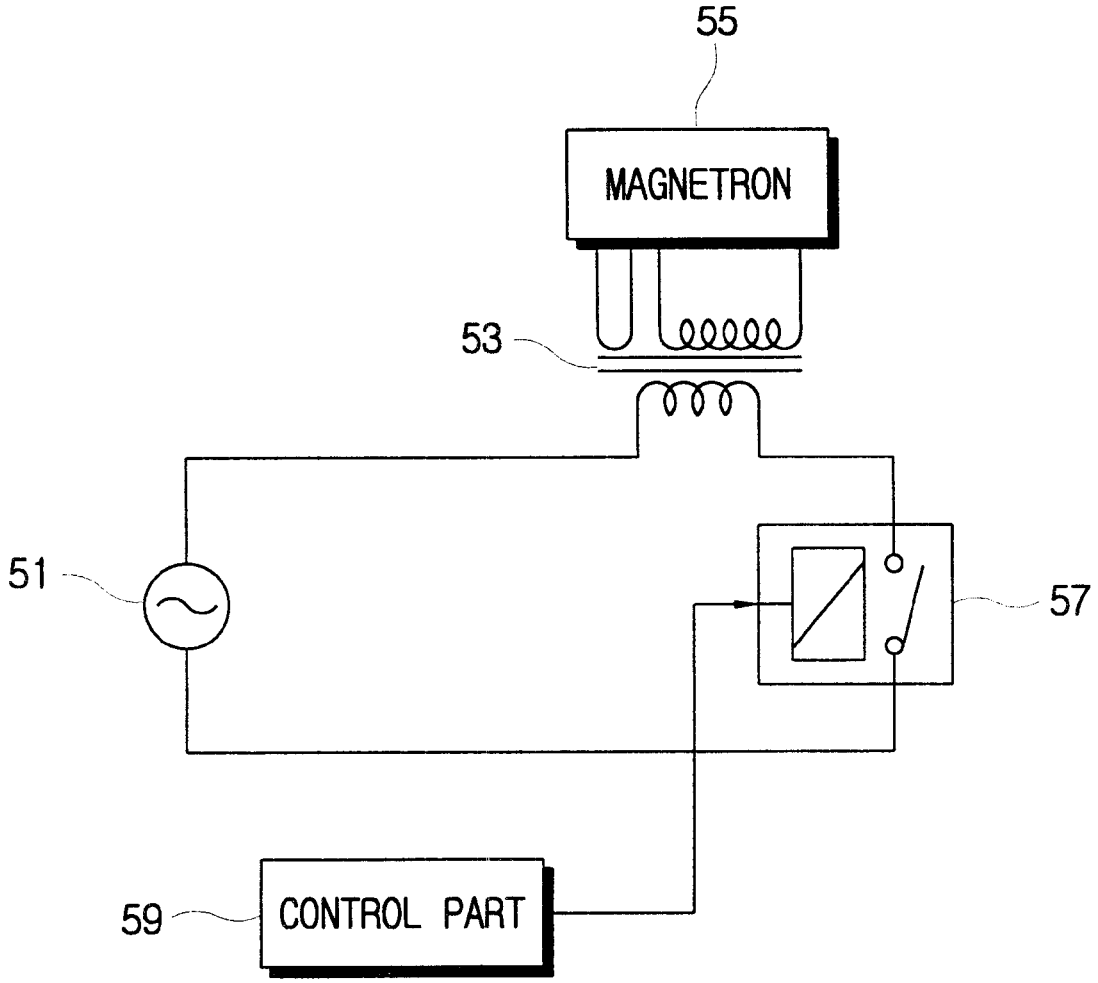
FIG. 6 (PRIOR ART)
FIG. 6 is a block diagram of a conventional microwave oven.

As shown in FIG. 5 which is a graph showing operational characteristics of a detector part, before the inverter part 30 starts to operate, that is, when the central voltage (P6) of the resonance part 6 is V/2 during suspension of the inverter part 30, the optimum soft start is realized. Here, V means the DC voltage applied to a collector of the switching power element 22 and a resonance capacitor 602 through a reactor 9. Where the commercial AC power supply is 220V, V is about 310V, and thus, V/2 is about 155V. AV@ means the DC voltage applied to a collector of the switching power element 22 and a resonance capacitor 602 through a reactor 9. Where the commercial AC power supply is 220V, V is about 310V, and thus, V/2 is about 155V.

To adapt the voltage (P6) to the level of V/2, a value of a pull-up resistor 502 should be equal to a sum of a value of the resistor 601 and the resistor 505. However, the value of the resistor 505 is so small as to be ignorable, in comparison with the resistor 601, the resistor 502 have the same value as that of the resistor 601, thereby allowing the DC bias of V/2 level to be supplied the central point (P6) of the resonance part 6.

The main feature of the inverter for the microwave oven according to the present invention is to generate a high voltage through an oscillation of semiconductor, and further, to enhance or lower the strength of the high voltage obtained from the semiconductor oscillation by varying the oscillating frequencies. If the oscillating frequencies are lowered, the resonance current is increased, thereby increasing the high voltage. Conversely, if the oscillating frequencies are heightened, the secondary high voltage is lowered.

The output of the microwave oven, that is, of the magnetron, is proportional to the strength of the secondary high voltage of the high voltage transformer, and therefore, the output of the microwave oven is controlled by controlling the secondary high voltage.

As stated above, the microwave oven according to the present invention enables precision control and output control by feeding back a control signal to the microwave oven. By detecting an abnormal status of the control signal, the circuit system is protected, thereby enhancing the stability thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising a power supply part supplying alternating current (AC) power, a rectifying and filtering part rectifying and filtering the commercial AC power, a high voltage transformer generating a high voltage by means of direct current (DC) power from the rectifying and filtering part, and a magnetron generating electromagnetic waves based on the high voltage from said high voltage transformer, further comprising:

a control signal generator part generating a control signal;

an inverter part converting the DC power from said rectifying and filtering part into a high voltage AC power in accordance with the control signal from said control signal generator part, and a control part blocking the control signal converted through said inverter part from being applied to the magnetron if the converted control signal is not within a predetermined range, said control part preventing the control signal from entering into said inverter part where the control signal is not within the predetermined range, said control part comprising:

a D/A converter part converting the control signal from said control signal generator part into an analog signal;

a detector part detecting whether the control signal converted by said D/A converter part is within the predetermined range;

an output control part controlling an output of the control signal passing through said detector part; and an oscillator part varying the control signal outputted by said output control part and inputting the varied control signal into said inverter part.

2. The microwave oven according to claim 1, wherein the control part further comprises an on-off and soft starter part controlling an on-off operation and a soft start operation of the oscillator part depending upon the control signal.

3. The microwave oven according to claim 2, wherein the control part further comprises a low voltage off part supplying a stop signal to the on-off and soft starter part and the D/A converter part where an abnormal power is inputted through the power supply part, to stop an operation of the on-off and soft starter part and the D/A converter part.

4. The microwave oven according to claim 3, wherein the low voltage off part is comprised of a transistor and a photo coupler which are connected in series to each other, to form a logical product (AND) circuit element.

5. The microwave oven according to claims 2, wherein the control part divides the control signal from the control signal generator part into the on-off and soft starter part and the D/A converter part.

6. The microwave oven according to claim 2, wherein the on-off and soft starter part uses a resistance property between a drain and a source of an FET.

7. The microwave oven according to claim 1, wherein the control signal detected by the detector part is applied to an input terminal of the output control part.

8. The microwave oven according to claim 7, wherein the output control part uses a resistance property between a drain and a source of a field effect transistor (FET).

9. The microwave oven according to claim 1, wherein the oscillator part comprises a switching part switching the DC power into an AC power.

10. The microwave oven according to claim 9, wherein the oscillator part connects and oscillates an external resistance and a capacitor to generate a gate pulse of the switching part.

11. The microwave oven according to claim 10, wherein an oscillating frequency of the oscillator part is given an expression Fo=1/(1.4×(external resistance+75)×capacitor).

12. A microwave oven, comprising:

a power source generating direct current power;

a control signal generator generating a control signal;

a converter coupled to said control signal generator to convert said control signal into a first voltage signal;

a detecting circuit coupled to said converter to receive said first voltage signal and to make a comparison between said first voltage signal and a reference, said detector generating a second voltage signal in response to said comparison;

a starting circuit coupled to said control signal generator to generate a third voltage signal when said control signal is generated from said control signal generator and when said control signal is in a predetermined range;

a control circuit having an output controller coupled to both said detecting circuit and said starting circuit to generate a fourth voltage signal in response to both said second voltage signal and said third voltage signal, said output controller varying said fourth voltage signal in response to said second voltage signal, said control circuit generating a switching signal in response to said fourth voltage signal, said control circuit varying the frequency of said switching signal in accordance with said fourth voltage signal; and an inverter coupled to said control circuit to convert said direct current power into alternative current power in response to said switching signal.

13. The microwave oven of claim 12, said detecting circuit coupled to said inverter to detect said alternative current power, said detecting circuit generating said second signal in response to both said first signal and said alternative current power.

14. The microwave oven of claim 12, further comprising:

said power source converting an external alternative power source into said direct current power; and said control circuit having a low voltage detector and generating a stop signal to said converter and said output controller of said inverter to prevent said control circuit from generating said fourth voltage signal when a voltage of said external alternative power source is lower than a second reference.

15. The microwave oven of claim 14, said power source coupled to said output controller to supply said voltage to said output controller generating said fourth voltage signal in response to said second voltage signal, said third voltage signal, and said voltage.

16. The microwave oven of claim 12, said converter being a D/A converter, converting said control signal into said first voltage signal which is an analog signal.

17. The microwave oven of claim 12, said output controller being a field effect transistor (FET) having a gate terminal coupled to said detecting circuit to receive said second voltage signal, one of a drain terminal and a source terminal of said FET coupled to said starting circuit to receive said third voltage signal.

18. The microwave oven of claim 17, said control circuit having an oscillator coupled between said FET of said output controller and said inverter to receive said fourth voltage signal generated from said FET, said oscillator generating said switching signal in response to said fourth voltage signal.

19. A method controlling an inverter in a microwave oven, comprising the steps of:

generating a control signal;

converting said control signal into a first voltage signal;

making a comparison between said first voltage signal and a reference;

generating a second voltage signal in response to said comparison;

generating a third voltage signal when said control signal exists;

generating a fourth voltage signal in response to said second voltage signal and said third voltage signal, said fourth voltage signal generated when said third voltage signal exists, said fourth voltage varying when said second voltage signal varies; and generating a switching signal in response to said fourth voltage signal and applying said switching signal to said inverter.

20. The method of claim 19, further comprising the steps of:

providing a power source generating first alternative current power and converting the first alternative current power into direct current power;

providing said inverter converting said direct current power into second alternative current power; and generating said second voltage in response to said comparison and said first alternative current power.

21. The method of claim 20, further comprising the step of making said comparison between said reference and a summation of said first voltage signal and a voltage of said second alternative current power.

* * * * *